US011278915B1

(12) United States Patent
Nilsen et al.

(10) Patent No.: US 11,278,915 B1
(45) Date of Patent: Mar. 22, 2022

(54) DEVICE FOR CAPTURING AND RELEASING MAGNETIC PARTICLES

(71) Applicant: NeoGeneStar LLC, Somerset, NJ (US)

(72) Inventors: Thor Nilsen, Stirling, NJ (US); Nancy Quan, Warren, NJ (US)

(73) Assignee: NeoGeneStar LLC, Somerset, NJ (US)

( * ) Notice: Subject to any disclaimer, the term of this patent is extended or adjusted under 35 U.S.C. 154(b) by 106 days.

(21) Appl. No.: 16/516,993

(22) Filed: Jul. 19, 2019

Related U.S. Application Data

(60) Provisional application No. 62/700,996, filed on Jul. 20, 2018.

(51) Int. Cl.
*B03C 1/01* (2006.01)
*B03C 1/28* (2006.01)
*B03C 1/12* (2006.01)

(52) U.S. Cl.
CPC ..... *B03C 1/01* (2013.01); *B03C 1/12* (2013.01); *B03C 1/28* (2013.01); *B03C 2201/20* (2013.01); *B03C 2201/22* (2013.01)

(58) Field of Classification Search
CPC .... B03C 1/01; B03C 1/12; B03C 1/28; B03C 1/10
See application file for complete search history.

(56) References Cited

U.S. PATENT DOCUMENTS 2,905,147 A 9/1959 Johnmann
3,567,026 A 3/1971 Kolm
3,652,173 A 3/1972 Miller et al.
3,676,337 A 7/1972 Kolm
3,902,994 A 9/1975 Miller et al.
4,141,687 A 2/1979 Forrest et al.
4,178,029 A * 12/1979 LaPan ..... H01F 7/0257 294/65.5
4,554,088 A 11/1985 Whitehead et al.
4,649,116 A * 3/1987 Daty ..... B25B 11/002 435/287.2
4,663,029 A 5/1987 Kelland et al.
5,108,933 A 4/1992 Liberti et al.
5,200,084 A 4/1993 Liberti et al.
(Continued)

FOREIGN PATENT DOCUMENTS

WO 2012122627 A 9/2012

*Primary Examiner* — Patrick H Mackey
(74) *Attorney, Agent, or Firm* — Burns & Levinson, LLP; Shawn P. Foley

(57) ABSTRACT

A device for capturing and releasing magnetically susceptible particles includes a housing and a retraction mechanism. A permanent axially magnetized cylindrical magnet is coupled to the retraction mechanism and a distal end of the magnet extends from a distal end of the housing. The retraction mechanism is configured to position the distal end of the magnet at one of three different predetermined distances from the distal end of the housing: retracted, protracted and hyper-protracted. A sleeve is provided over the housing distal end and when the magnet is in the protracted position, magnetically susceptible particles are gathered, when in the retracted position, magnetically susceptible particles are released and the sleeve is ejected when the magnet is positioned at a point between the protracted and the hyper-protracted position.

24 Claims, 10 Drawing Sheets

(56) References Cited

U.S. PATENT DOCUMENTS

| | | | | |
|---|---|---|---|---|
| 5,288,119 | A * | 2/1994 | Crawford, Jr. | B25B 9/00 29/270 |
| 5,466,574 | A | 11/1995 | Liberti et al. | |
| 5,622,831 | A | 4/1997 | Liberti et al. | |
| 5,647,994 | A * | 7/1997 | Tuunanen | B03C 1/288 210/695 |
| 6,451,207 | B1 | 9/2002 | Sterman et al. | |
| 6,468,810 | B1 * | 10/2002 | Korpela | G01N 33/54326 436/526 |
| 6,695,004 | B1 | 2/2004 | Raybuck | |
| 7,219,567 | B2 * | 5/2007 | Porat | B01L 3/021 436/180 |
| 7,622,046 | B2 | 11/2009 | Rundt et al. | |
| 8,084,271 | B2 * | 12/2011 | Korpela | B03C 1/286 436/177 |
| 8,465,453 | B2 | 6/2013 | Sandhu et al. | |
| 9,568,403 | B2 | 2/2017 | Tuunanen | |
| 9,808,232 | B2 | 11/2017 | Heiman | |
| 9,964,469 | B2 | 5/2018 | Flynn et al. | |
| 9,970,952 | B2 | 5/2018 | Liu et al. | |
| 2017/0266653 | A1 * | 9/2017 | Pollack | B03C 1/0335 |

* cited by examiner

DEVICE FOR CAPTURING AND RELEASING MAGNETIC PARTICLES

RELATED APPLICATION

This application is a non-provisional application claiming priority to U.S. Provisional Application Ser. No. 62/700,996, filed on Jul. 20, 2018 entitled "Device For Capturing And Releasing Magnetic Particles," the entire contents of which is hereby incorporated by reference for all purposes.

FIELD OF THE INVENTION

The disclosure relates to a magnetic device for capturing and releasing magnetically susceptible particles.

BACKGROUND OF THE INVENTION

Devices for capturing and releasing magnetized, ferromagnetic, or superparamagnetic micro-particles are known. Generally, these devices include a movable magnet as well as either an extendable membrane, a shapeable membrane or a coating on the magnet.

What is needed is an improved device for capturing and releasing magnetically susceptible particles.

SUMMARY OF THE INVENTION

In one aspect of the present disclosure, a device for capturing and releasing magnetically susceptible particles comprises: a housing having a proximal end and a distal end; a retraction mechanism disposed within the housing; and a permanent, axially magnetized, cylindrical magnet disposed in the housing and coupled to the retraction mechanism, wherein a distal end of the magnet extends from the distal end of the housing, and wherein the retraction mechanism is configured to position the distal end of the magnet at one of a first, second or third predetermined distance from the distal end of the housing.

Another aspect of the present disclosure relates to a device for capturing and releasing magnetically susceptible particles that comprises: a housing having a proximal end and a distal end; a retraction mechanism, having a proximal end and a distal end, disposed within the housing; a planar structure disposed in the housing and coupled to the distal end of the retraction mechanism; and a plurality of permanent axially magnetized cylindrical magnets coupled to the planar structure, each magnet having a distal end extending from the distal end of the housing, wherein the retraction mechanism is configured to position the distal ends of the magnets at one of a first, second or third predetermined distance from the distal end of the housing.

In some embodiments with respect to these two aspects, the device further comprises a sleeve coupled to the distal end of the housing, wherein the sleeve is sized and arranged such that the magnet can move to the second predetermined distance without disturbing the coupling of the sleeve to the housing.

In some embodiments with respect to these two aspects, the device further comprises a ferromagnetic tube disposed over the magnet.

Yet another aspect of the present disclosure relates to a device for capturing and releasing magnetically susceptible particles comprises: a housing having a proximal end and a distal end; a displacement mechanism, having a proximal end and a distal end, disposed within the housing; a plurality of magnetic assemblies coupled to the housing, each magnetic assembly having a distal end extending from the distal end of the housing; a pusher plate coupled to the distal end of the displacement mechanism; a plurality of openings defined in the pusher plate, each opening configured and arranged to accommodate a respective magnetic assembly; and a plurality of sleeves, each sleeve disposed over a respective magnetic assembly and positioned adjacent the pusher plate, wherein each magnetic assembly comprises a cylindrical magnet disposed inside a ferromagnetic tube, and wherein the displacement mechanism is configured to move the pusher plate from a first position to a second position and back to the first position.

Advantageously, the device in accordance with aspects of the present disclosure has a retraction mechanism that allows for a single-handed, single digit, i.e., single finger, operation for placing a magnet in one of at least three different positions, including a protracted or retracted position for the capture and release, respectively, of magnetically susceptible particles, and a hyper-protracted position for the release of a disposable cover. The device allows the user to more easily move between the retracted and protracted positions to facilitate the movement of particles. In the hyper-protracted position, the magnet can eject the sleeve without the need for a separate ejection mechanism, thus simplifying the design. Further, the device eliminates the need to use a pipette or vacuum to remove liquid.

BRIEF DESCRIPTION OF THE DRAWINGS

One or more aspects of the present disclosure are discussed below with reference to the accompanying Figures. It will be appreciated that for simplicity and clarity of illustration, elements shown in the drawings have not necessarily been drawn accurately or to scale. For example, the dimensions of some of the elements may be exaggerated relative to other elements for clarity or several physical components may be included in one functional block or element. Further, where considered appropriate, reference numerals may be repeated among the drawings to indicate corresponding or analogous elements. For purposes of clarity, however, not every component may be labeled in every drawing. The Figures are provided for the purposes of illustration and explanation and are not intended to be limiting. In the Figures.

DETAILED DESCRIPTION

The entire contents of U.S. Provisional Application Ser. No. 62/700,996, filed on Jul. 20, 2018 entitled "Device For Capturing And Releasing Magnetic Particles," is hereby incorporated by reference for all purposes.

In the following description, numerous specific details are set forth in order to provide a thorough understanding of the aspects and implementations of the present disclosure. It will be understood by those of ordinary skill in the art that these may be practiced without some of the specific details that are set forth. In some instances, well-known methods, procedures, components and structures may not have been described in detail so as not to obscure the details of the implementations of the present disclosure.

Generally, various aspects of the present disclosure provide for, among others, a handheld device for capturing and releasing, i.e., transferring, magnetically susceptible particles by positioning a magnet at one of three different positions: retracted, protracted and hyper-protracted. The device also incorporates a friction mechanism for plastic sleeve attachment allowing the magnet to move within the sleeve and to eject the sleeve. Manual selection of the three positions is achieved with a push button operated retraction mechanism allowing for one-handed, single digit (finger) operation. In addition, as will be described below, magnetically susceptible material is utilized to extend the length of permanent magnets and to diffuse one pole of a permanent magnet.

Figures 1A, 1B, 1C:
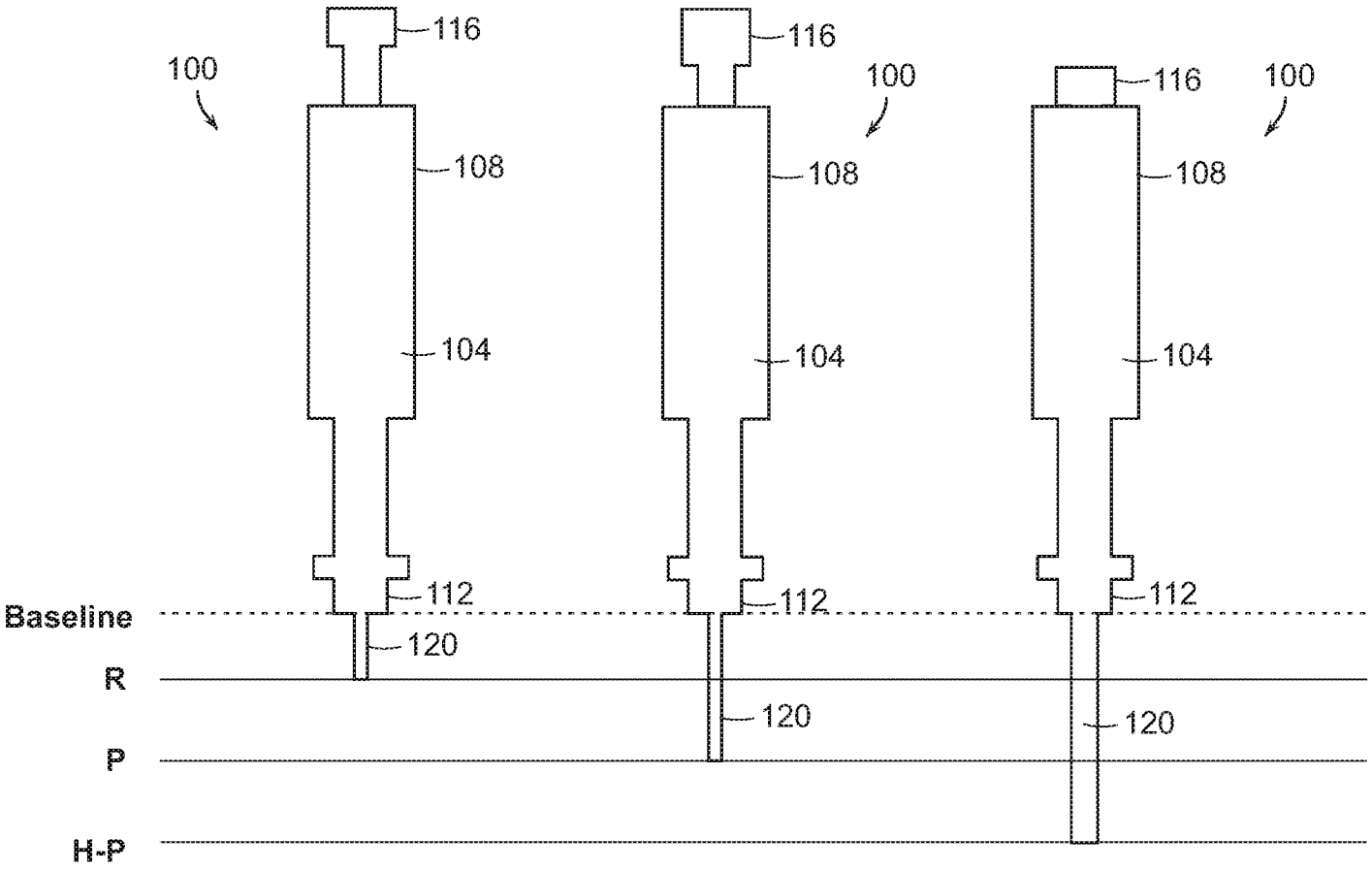
FIGS. 1A-1C represent a device for capturing and releasing magnetically susceptible particles in accordance with an aspect of the present disclosure.

Referring now to FIGS. 1A-1C, a handheld device 100 includes a hollow cylindrical housing 104 having a proximal end 108 and a distal end 112. The housing 104 may be made from, for example, nylon or any appropriate material. A button 116 extends from the proximal end 108 and a linear magnet 120 extends from the distal end 112. The magnet 120 may be made from axially magnetized NdFeB material, for example, 1 inch in length, 3/16 inch diameter with a 0.0006 inch (15 to 21 microns) coat of nickel, grade "N52."

The device 100 is configured to position an end of the magnet 120 from the distal end 112 at three positions: retracted (R), protracted (P) and hyper-protracted (H-P). The retracted position is closest to the distal end 112, the hyper-protracted position is farthest from the distal end 112 and the protracted position is between the other two positions, as shown.

Figures 2A, 2B, 2C:
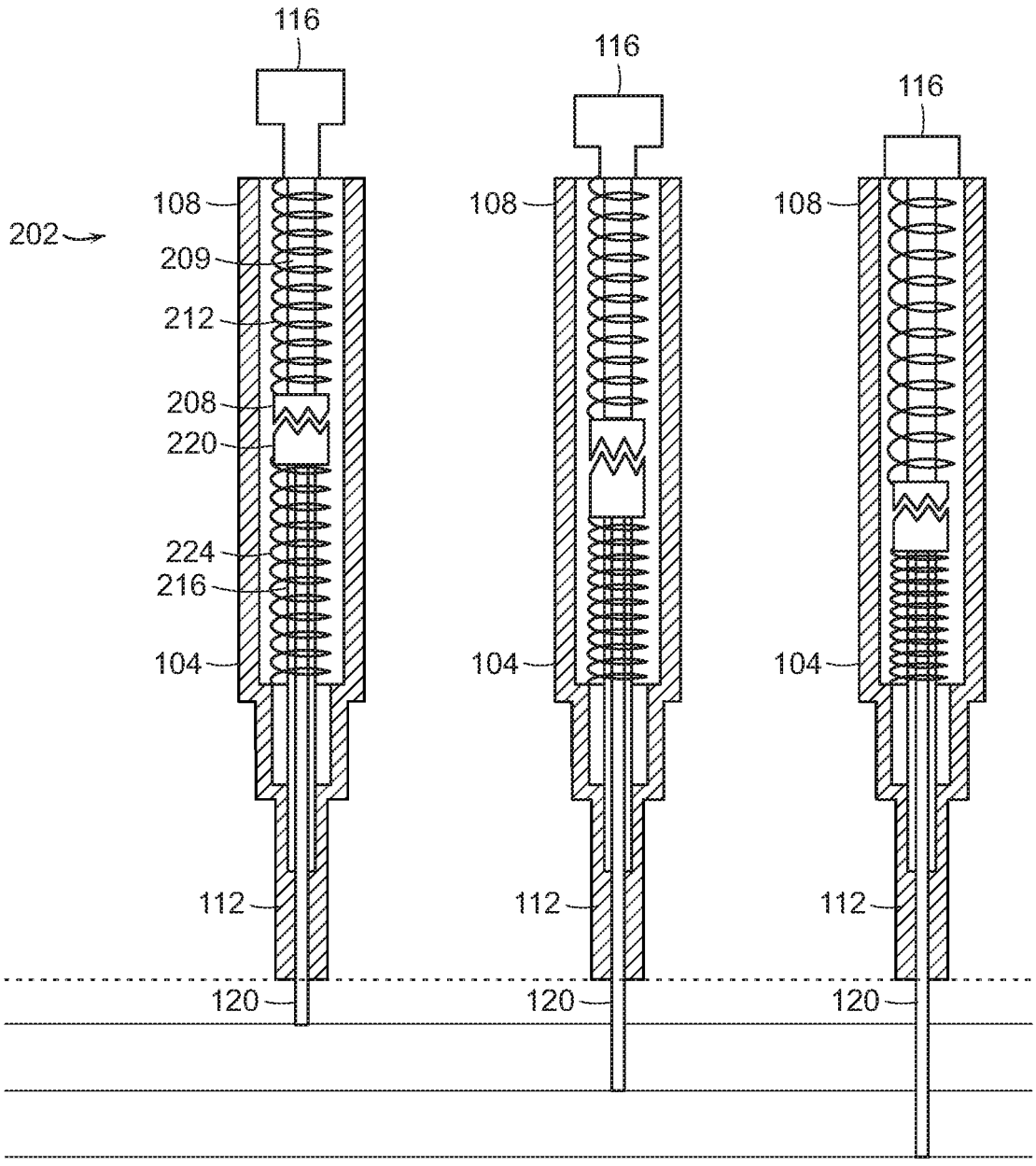
FIGS. 2A-2C represent a cross-sectional view of the device for capturing and releasing magnetically susceptible particles shown in FIGS. 1A-1C.

The device 100, as shown in cross-sectional view in FIGS. 2A-2C, includes a retraction mechanism 202. As shown, the retraction mechanism 202 has an upper ratchet shaft 204 with a first end coupled to an upper ratchet 208 and a second end coupled to the button 116. An upper spring 212 is provided that urges the upper ratchet 208 away from the proximal end 108. The retraction mechanism 202 also includes a lower ratchet shaft 216 with a first end coupled to a lower ratchet 220 along with a lower spring 224 provided to urge the lower ratchet 220 away from the distal end 112. Although not shown, respective cams are provided to operate with the upper and lower ratchets. A second end of the lower ratchet shaft 216 is coupled to the magnet 120. The retraction mechanism 202 is similar to those used in retractable writing instruments as disclosed in, for example, U.S. Pat. Nos. 2,905,147 and 3,652,173, each of which is incorporated by reference in its entirety for all purposes.

Advantageously, the retraction mechanism 202 operates to position the magnet 120 at one of the retracted, protracted and hyper-protracted positions. As shown in FIG. 2A, in the retracted position, a tip of the magnet 120 is mostly withdrawn. As shown in FIG. 1B, with one press of the button 116, that is, a next "click" of the retraction mechanism 202, the magnet 120 is extended to the protracted position. The magnet 120 is held there due to the ratcheting function of the retraction mechanism 202. A subsequent pressing of the button 116 to "click" again returns the magnet 120 to the protracted position. As shown in FIG. 1C, when the button 116 is pressed and held beyond that position necessary to "click," but not necessarily as far as it will go, the magnet 120 is placed at the hyper-protracted position. The retraction mechanism 202 allows a user to more easily position the magnet in one of the retracted, protracted or hyper-protracted positions.

The retracted, protracted and hyper-protracted positions, and the differences there between, are established based on choice of the lengths of the upper and lower ratchet shafts 208, 216, the length of the push button 116 and the length of the magnet 120, as well as the lengths and/or strengths of the upper and lower springs 212, 224.

Figure 3C:
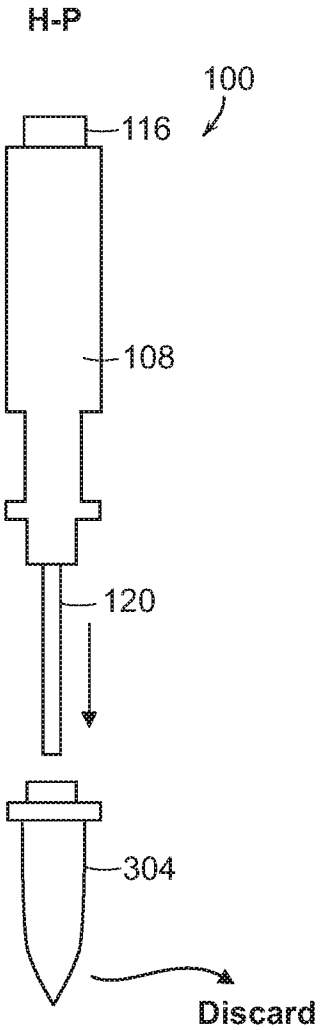
FIGS. 3A-3C represent operation of the device of FIGS. 1A-2C.
Figure 3B:
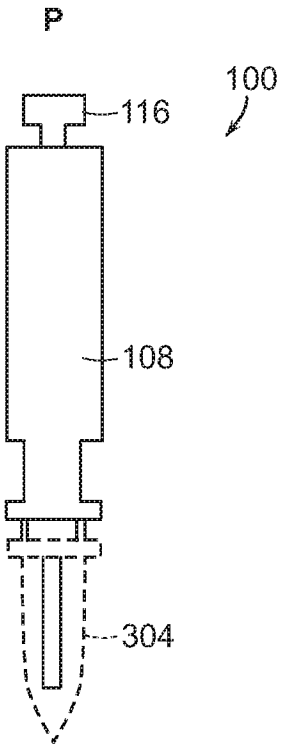
Figure 3A:
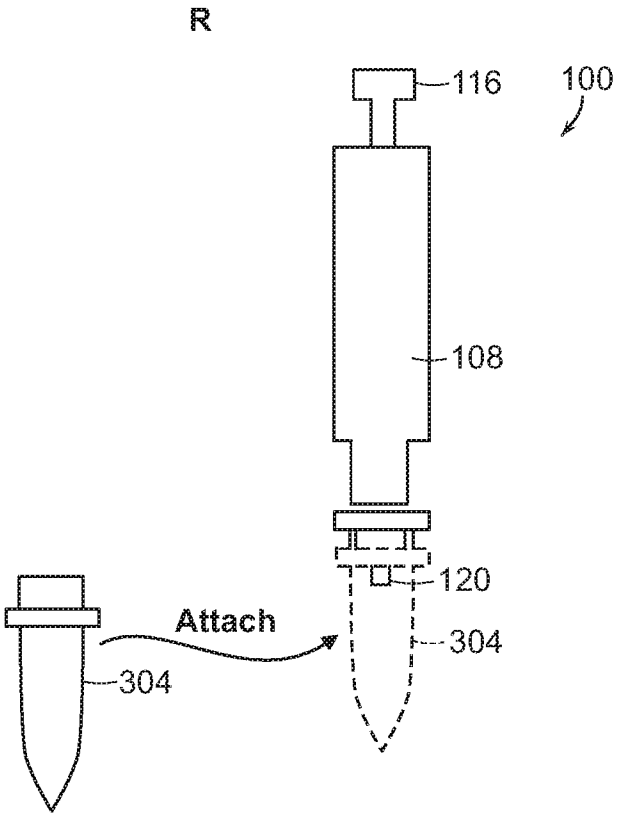
Figure 4:
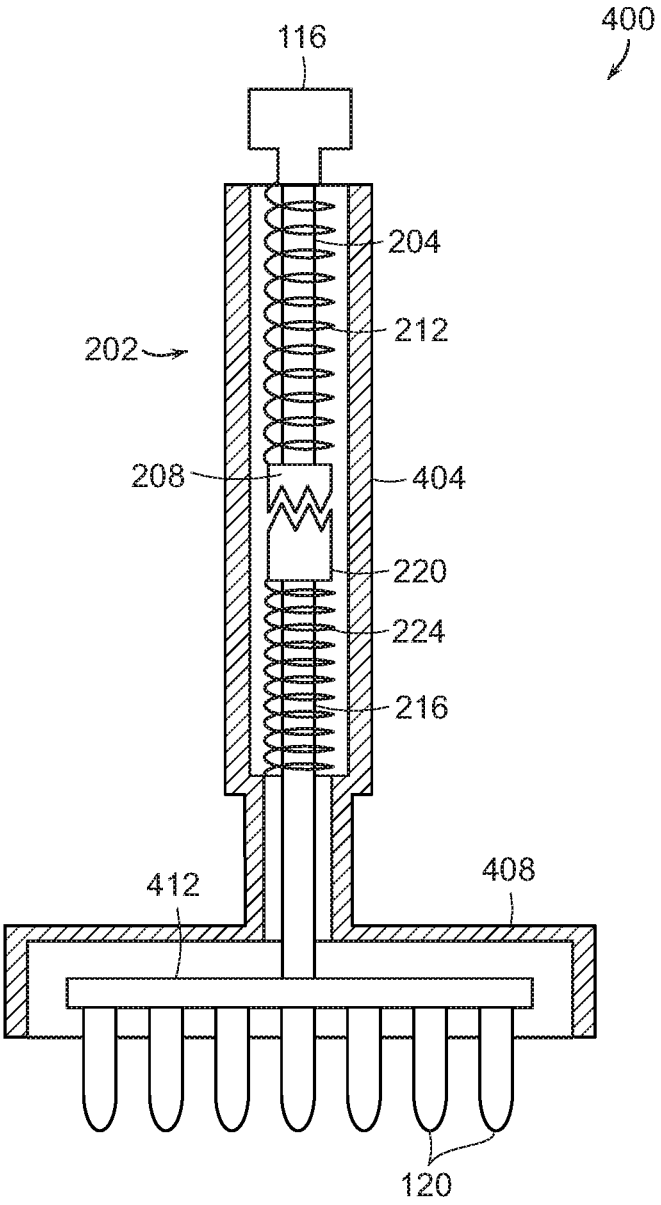
FIG. 4 is a cross sectional view of another device for capturing and releasing magnetically susceptible particles in accordance with another aspect of the present disclosure.

Referring now to FIGS. 3A-3C, a removable sleeve 304 is placed in an opening in the distal end 112 of the device 100 and, therefore, around the magnet 120. The sleeve 304 can be made of any material that is non-magnetic, is permissive to magnetic fields, inert to the chemicals present in the solution with the magnetic particles, and exhibits minimal non-specific particle binding in the absence of a magnetic field. For example, the sleeve may be a polypropylene sleeve (e.g., commercially available from PerkinElmer, Waltham, Mass. as Cat #CMG-554). The sleeve 304 is pressed onto the device 100 and is maintained in place due to a friction fit, i.e., the sleeve 304 is attached by a slip-fit coupling to the housing 108 around the outside of the sleeve 304.

As shown in FIGS. 3A and 3B, the sleeve 304 can be placed when the magnet 120 is in either the retracted or the protracted position, respectively. As a result, when the magnet/sleeve combination is placed into a solution, and the magnet is placed in the extended position and magnetically susceptible particles in the solution are attracted to the surface of the sleeve.

When the magnet 120 is in the retracted position, the magnet 120 is too far away and, as a result, the local magnetic field is not strong enough to attract particles. Thus, the magnetically susceptible particles are not attracted to the magnet 120. When the sleeve 304 is placed in a vial of the solution and the magnet 120 is placed in the protracted position, the magnetically susceptible particles can be captured from the solution and then processed per known procedures.

With the magnet 120 in the protracted position and separated magnetically susceptible particles are present on the surface of the sleeve 304, the particles can be transferred from one solution to another without the need for pipetting or aspiration.

During processing, the magnet 120 may be moved back and forth from the protracted and retracted positions multiple times to gather and release, respectively, the magnetically susceptible particles to and from different solution or vials.

When the procedure is complete, the button 116 is pressed past the "click" position to place the tip of the magnet 120 at some point beyond the protracted position and as far as the hyper-protracted position. Accordingly, and as shown in FIG. 3C, at some point between the protracted and the hyper-protracted positions, based on the lengths of the components in the retraction mechanism 202, the sleeve 304 is pushed off of the distal end 112 of the device 100, and discarded or sterilized for reuse. Accordingly, a separate ejection mechanism and, therefore, its additional components, are not needed.

Advantageously, the disposable sleeve 304 allows for: 1) magnetically susceptible particles to adhere to the sleeve 304 without coming in contact with the magnet 120; 2) the magnet 120 to move within the respective sleeve 304 to the protracted and retracted positions; 3) the magnet 120 to be used to eject the sleeve 304 in the hyper-protracted position; and 4) particle transfer between solutions without the use of aspiration, resuspension, or pipetting.

Referring now to FIGS. 4-8, a device 400 includes a plurality of magnets 120, for example, but not limited to, 12 magnets, for gathering/processing from multiple vials at a same time. Generally, a number of magnets is chosen to correspond with a number of wells in industry standard microtiter plates, e.g., a 96-well (8×12) plate. The device 400 includes a cylindrical housing 404 made from, for example, nylon, or similar material, and a multi-magnet opening 408 disposed at a distal end 412. The multi-magnet opening 408 has a plurality of holes to allow for a respective magnet 120 to move through.

Similar to the "single" device 100, the multi-magnet device 400 includes a retraction mechanism 202 in which a lower ratchet shaft 216 is coupled to a multi-magnet receiving bar 412 from which a plurality of magnets 120 extends. The receiving bar 412 may be made from aluminum or similar material. The cylindrical magnets 120 are mounted perpendicularly in the receiving bar 412 and parallel to one another. The magnets 120 are equally spaced from one another and the spacing can be chosen to correspond to the spacing of wells in an industry standard microtiter plate.

Figure 5A:
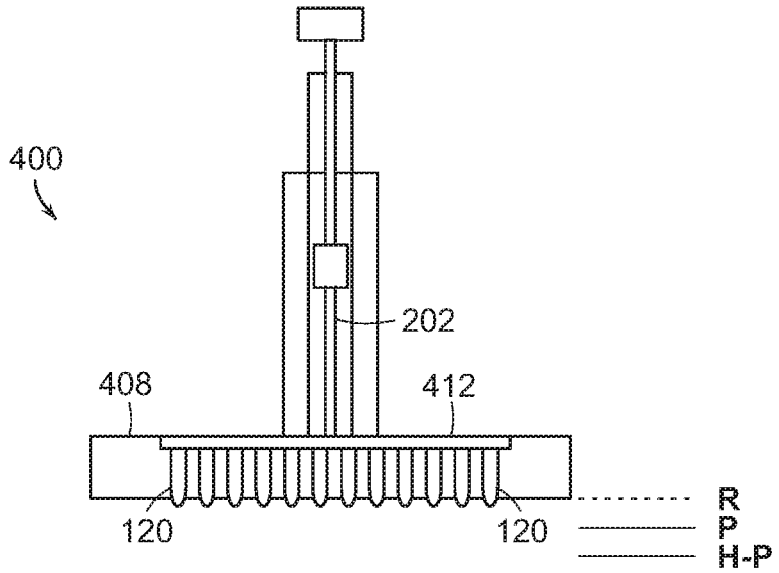
FIGS. 5A-5C represent operation of the device of FIG. 4.
Figure 5B:
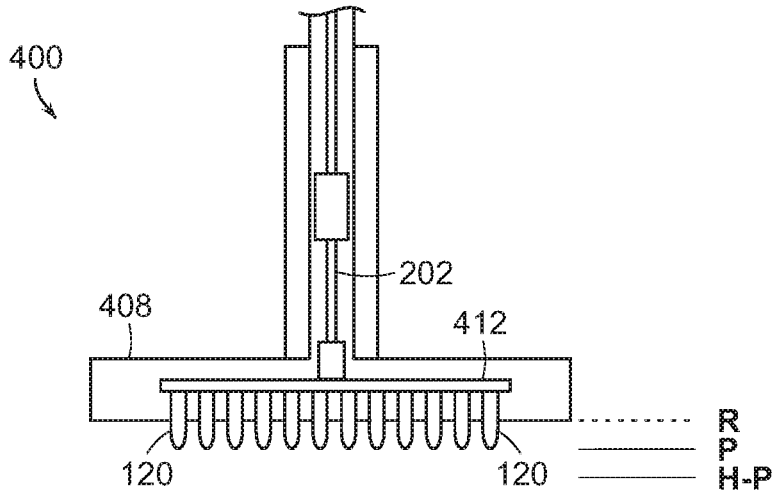
Figure 5C:
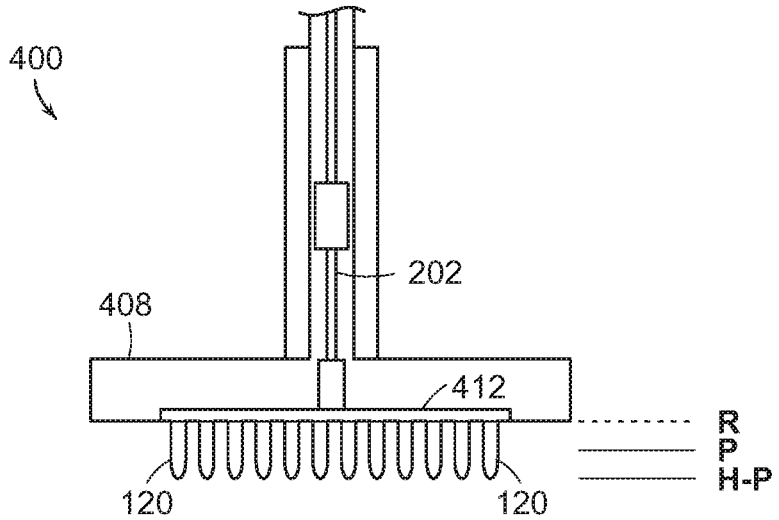

The ratchet mechanism 202 of the device 400 moves the receiving bar 412 and, therefore, the plurality of magnets 120, among the retracted (R), protracted (P) and hyper-protracted (H-P) positions, as shown in FIGS. 5A-5C.

Figure 6:
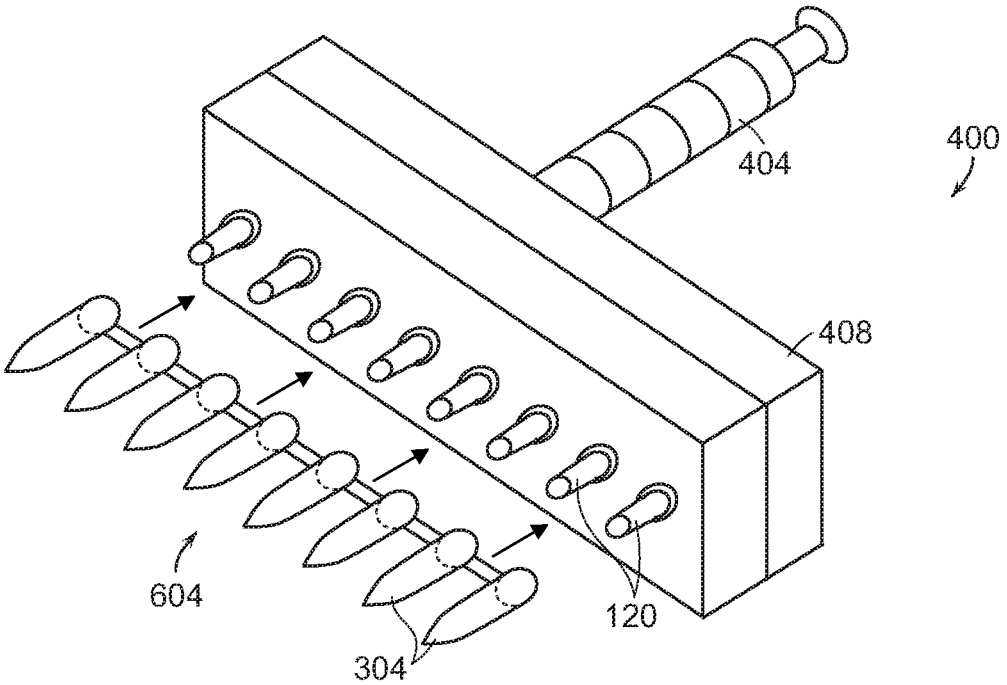
FIG. 6 is a perspective view of the device of FIG. 4.
Figure 7:
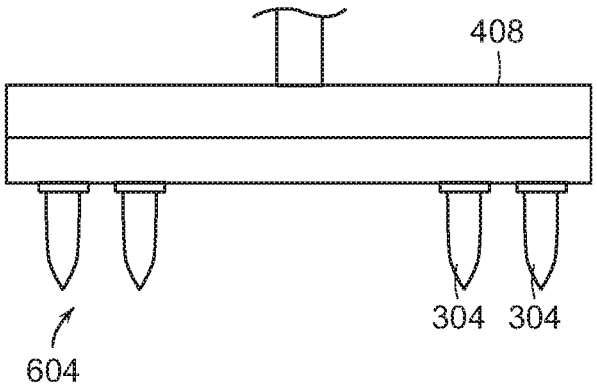
FIG. 7 is a side view of the device of FIG. 4.

As shown in FIGS. 6 and 7, a strip 604 of sleeves 304, arranged and spaced to correspond to the openings in the multi-magnet portion 408, is provided. The strip 604 is placed into the portion 408 and kept in place by a friction fit, similar to that which has been described above. Accordingly, magnetically susceptible particles can be processed, per known procedures, from/to multiple vials at the same time with the device 400.

The strip 604 may be any one of a number of commercially available PCR strips and tubes for use with, for example, 96 well microtiter plates. In one non-limiting example, for deep 24 well microtiter plates, commercially available 6-position and 24-position plastic sleeve covers are available. For 15 ml and 50 ml centrifuge tubes, long plastic sleeves are commercially available. The use of sterilizable plastic sleeves provides for the magnetic particle purification of cells with little or no damage due to centrifugation.

In some applications, a vial containing a solution with magnetically susceptible particles can be in a range of 3-9 inches deep, for example, commonly used 15 ml and 50 ml centrifuge tubes. Magnets made from NdFeB, however, are known to be brittle and increasing the length, relative to the diameter of the magnet, has a tendency to cause the magnets to become even more fragile. Commercially available NdFeB magnets with a diameter of about 0.1 inch are usually less than 1 inch in length while 0.25 inch diameter columnar magnets are usually less than 2 inches long. Accordingly, magnets that can be effectively used in these deeper centrifuge tubes are not commercially available.

Figure 8:
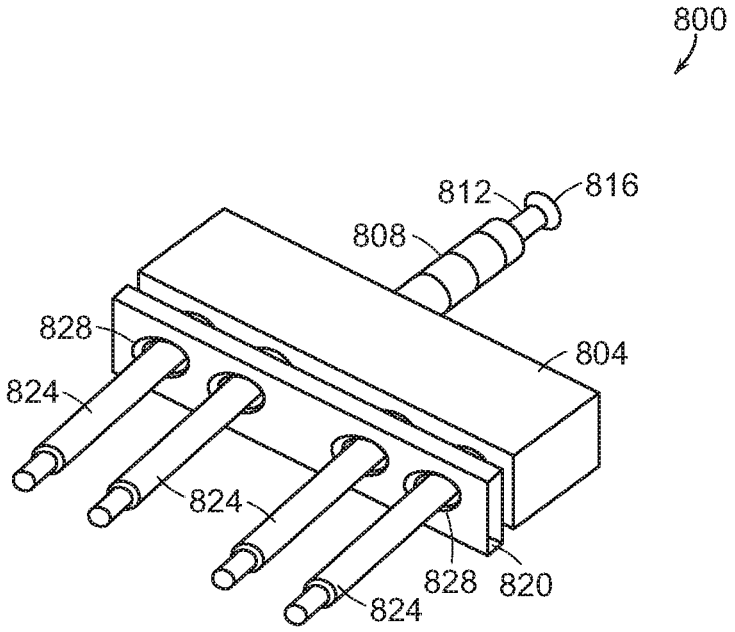
FIG. 8 is another device for capturing and releasing magnetically susceptible particles in accordance with another aspect of the present disclosure.

In order to work with solutions in deeper vials, a device 800, according to an aspect of the present disclosure, includes a housing 804 with a handle 808 and a spring-loaded shaft 812 disposed in the handle 808, as shown in FIG. 8. A button 816 is disposed on a proximal end of the shaft 812 and a pusher plate 820 is coupled to a distal end of the shaft 812. A plurality of cylindrical magnet assemblies 824 are disposed in the housing 804 and extend perpendicularly from the housing and parallel to one another. The pusher plate 820 has a plurality of openings 828 corresponding to the magnetic assemblies 824.

Figure 9:
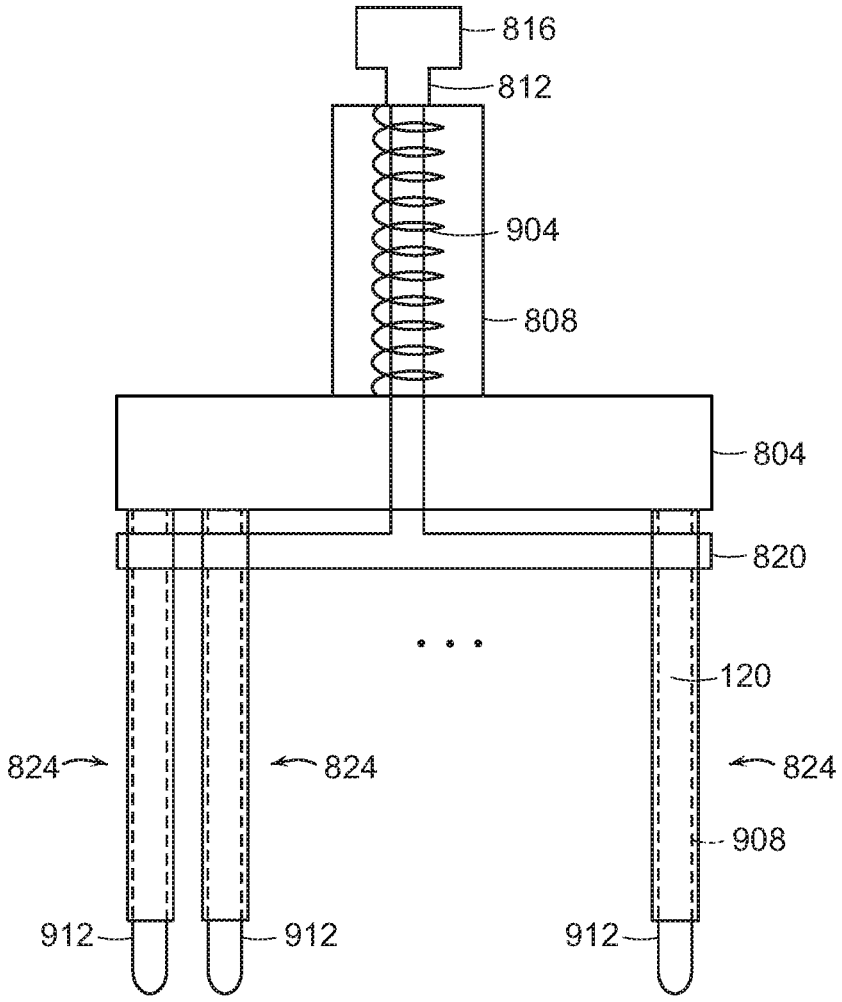
FIG. 9 is a partial cutaway view of the device of FIG. 8.

Referring now to FIG. 9, a partial cutaway view of the device 800, a spring 904 is disposed in the handle 808 to urge the pusher plate 820 into a position closest to the housing 804.

Each magnet assembly 824 includes a ferromagnetic tube 908 surrounding at least a portion of a cylindrical magnet 120 where a distal tip 912 of the magnet 120 extends from a distal end of the tube 908. The ferromagnetic tube 908 may be, for example, a cold rolled welded "soft" iron tube with a 0.25 inch OD, 0.165 inch ID with a 0.1875 inch bore 0.5 inch deep in the end to accept the magnet 120. Alternatively, 400 series stainless steel could be used. In one non-limiting example, the magnet 120 can be axially magnetized NdFeB, with a 0.1875 inch diameter and 1 inch long, inserted 0.5 inches into a 5 inch long, 0.25 inch OD, 0.165 inch ID 430 ferritic stainless steel tube with a 0.5 inch long bore of 0.1875 at one end where a ratio of the length of the ferromagnetic tube with magnet to the diameter of the magnet is 34.7.

Advantageously, at least three benefits are achieved by inserting one pole of the magnet 120 in the ferromagnetic tube 908: 1) the magnet 120 is mechanically protected; 2) the overall length can be adjusted by adjusting the length of the tube 908; and 3) the magnetic field lines on the pole of the magnet 120 inserted in the ferromagnetic tube 908 are dissipated. In other words, the magnet assembly 824 functions as a monopole magnet as the magnetic field of the pole of the magnet 120 that is wholly inside the tube 908 is minimized with respect to the distal tip 912 of each magnet assembly 824. The dissipation of the magnetic field lines at the pole of the magnet 120 that is wholly inside the tube 908 effectively enhances the capture of magnetic particles at the portion inserted into the solution, i.e., at the distal tip 912. Relatively long and thin magnet/sleeve combinations are particularly advantageous for magnetic particle purification in tubes and flasks. In general, the ferromagnetic tube 908 and magnet 120 may have a length of between 3 to 9 inches and a ratio of width to length of greater than 1:21.

Figure 10B:
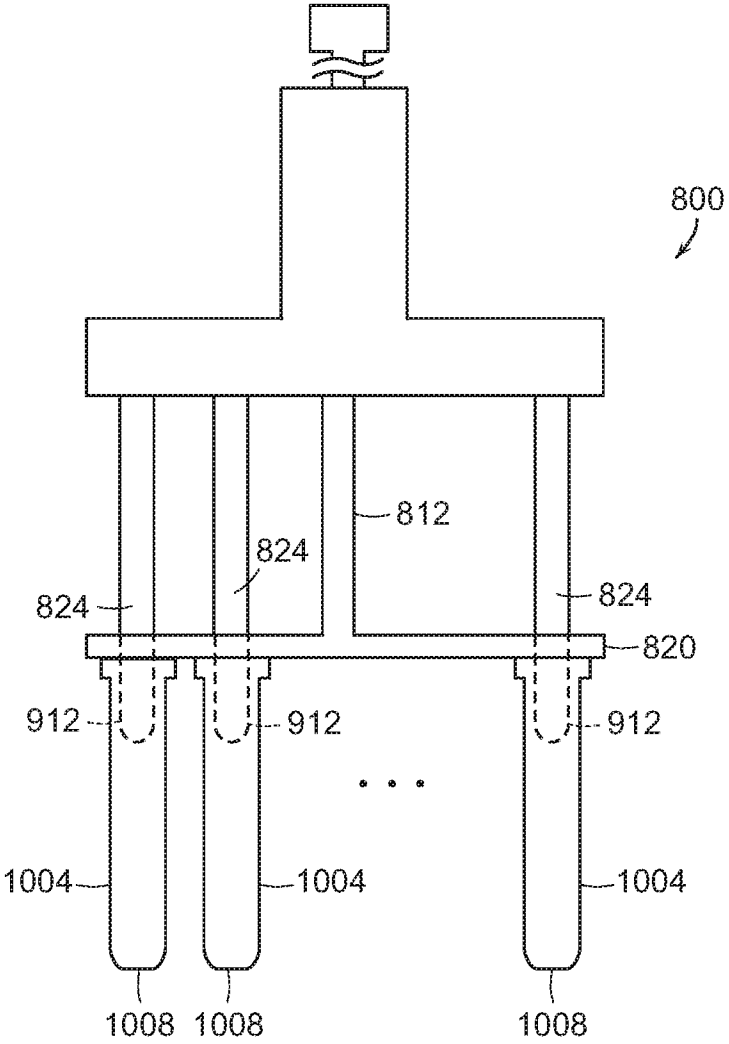
FIGS. 10A and 10B represent two states of operation of the device of FIG. 8.
Figure 10A:
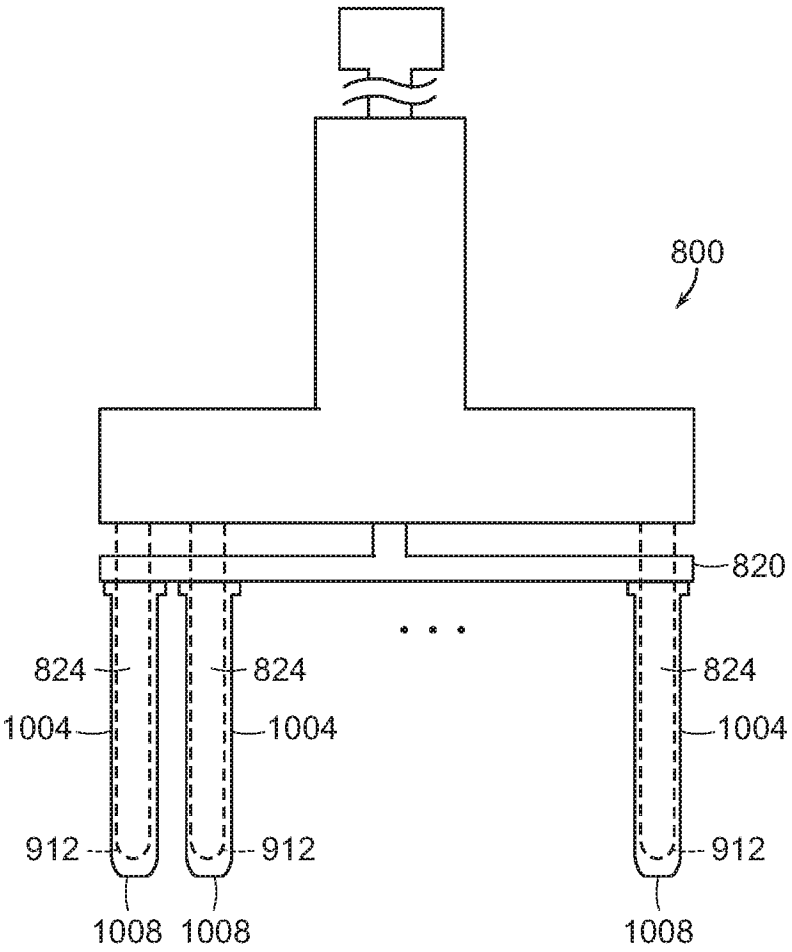

In operation, a sleeve 1004 may be disposed over at least a portion of each magnet assembly 824 as shown in FIG. 10A. The sleeve 1004 may be made from the same material as the sleeve 304 described above. As understood from the teachings herein, the sleeve 1004 is sized to accommodate the magnet assembly 824. The sleeve 1004 may be configured and sized to couple to the pusher plate 820 or may be configured and sized to be slidably coupled to the respective magnet assembly 824.

When positioned as shown in FIG. 10A, i.e., with the pusher plate 820 in a default, or initial, position by operation of the spring 904, the distal ends 912 of the magnet assemblies 824 are at a distal end 1008 of the sleeve 1004. When placed in a solution, any magnetically susceptible particles in the solution will be attracted and captured along the outside of the sleeve 1004, similar to the operation described herein.

When the shaft 812 is extended by pushing on the button 816, the pusher plate 820 will extend the sleeve 1004. Accordingly, as shown in FIG. 10B, the distal ends 912 of the magnet assemblies 824 will be withdrawn. In this position, any magnetically susceptible particles that had been attracted and present on the outside of the sleeve 1004 will fall off, thus facilitating transfer of the particles, as described above. When the shaft 824 and, therefore, the pusher plate 820 are returned to the initial position, the sleeve 1004, depending upon how it is coupled to the plate 820, will also return or can be pushed back into place against the plate 820. As described above, the spring 904 and the shaft 812 operate together as a displacement mechanism for moving the pusher plate 820.

When the pusher plate 820 is pushed past a predetermined point, the sleeve 1004 will be ejected and discarded.

In an alternate aspect of the present disclosure, the retraction mechanism 202 may be implemented in place of the spring 904 per the teachings set forth above.

Figure 11:
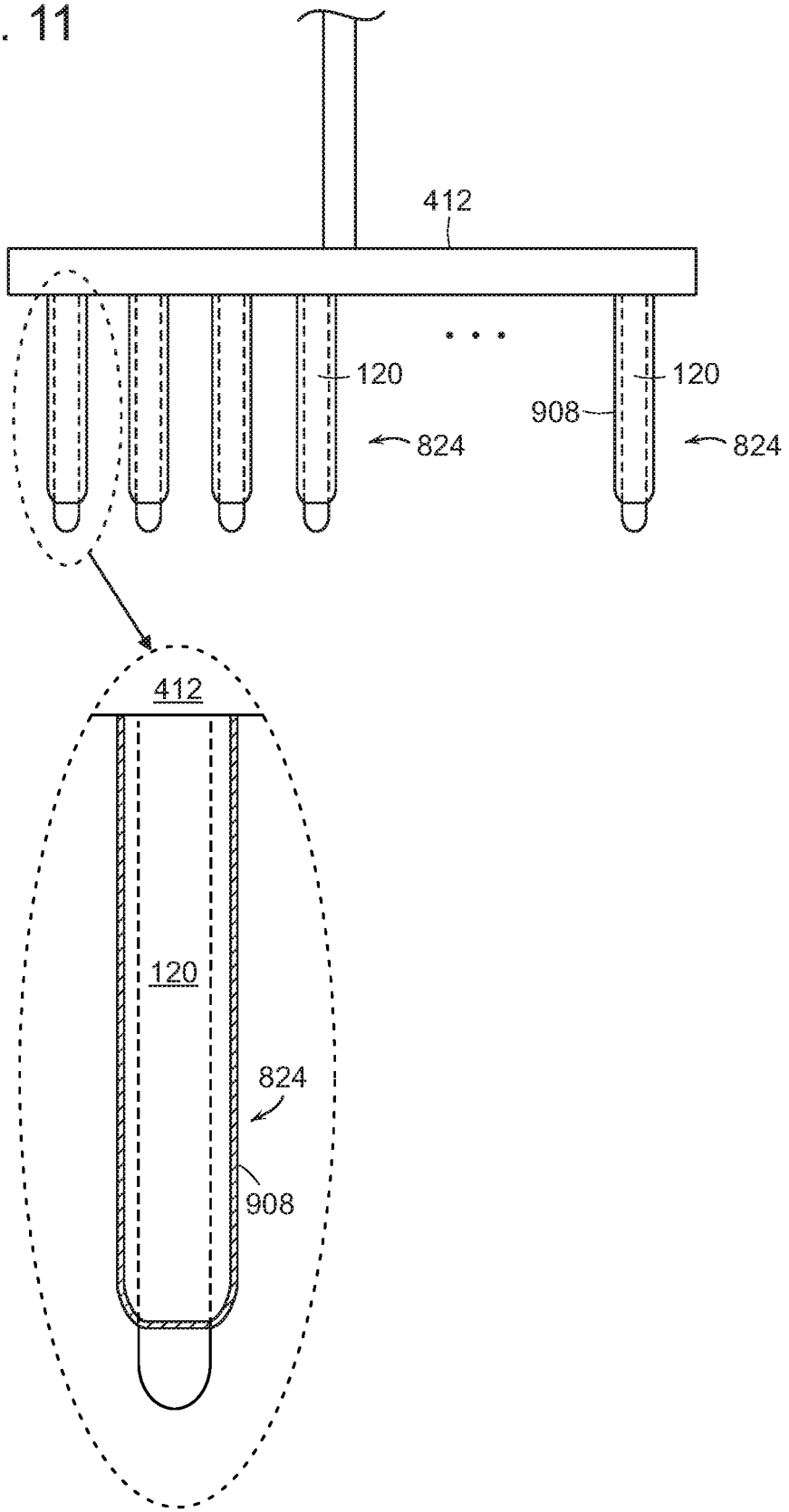
FIG. 11 is another aspect of the device of FIG. 4.

Although the magnet assembly 824 is shown in the multi-magnetic device 800, such a structure could also be provided in place of the magnets 120 in each of the single magnet device 100 and the multi-magnet device 400, described above, and shown in FIG. 11.

Merely as examples, and not to be considered limiting, for 96-well microtiter plate applications, the magnets may be from 0.05 to 0.20 inches in diameter and 0.5 to 2 inches in length and the device may have a protracted distance of between 0.30 and 2.0 inches and the protracted to hyper-protracted distance of between 0.1 and 0.75 inches. More specifically, for 96-well microtiter plates the magnets 120 may be about 0.1 inch in diameter and about 1 inch long for use with commercially available PCR strips and plates as the sleeve. For deep 24-well microtiter plates, the magnets may be 0.1875 to 0.4 inches in diameter and 0.5 to 3 inches in length where the retracted to protracted distance is between 1 inch and 2.5 inches and the protracted to hyper-protracted distance is between 0.1 and 0.75 inches. For deep 24-well microtiter plates, the magnets may be 0.1875 inches to 0.25 inches in diameter and 2.25 inches in length with a retracted to protracted distance of 1.5 inches and a protracted to hyper-protracted distance of 0.25 inches.

The present disclosure describes magnetic devices with a single magnet or a plurality of magnets having three linear positions: retracted, protracted and hyper-protracted. The magnetic device is designed to be used with disposable sleeves.

The following examples of methods for using the devices described herein are meant to be exemplary and not limiting.

Example 1: Purification of Xenograft Mouse Cell-Free DNA with a 3-Position, 12-Magnet Magnetic Device The process of purifying cell-free DNA (cfDNA) from xenograft mouse cancer models is useful for cancer characterization. In this approach, 12 xenograft mouse DNA samples are obtained via tail vein venipuncture and EDTA anti-coagulation. The blood samples are first subjected to centrifugation. Each sample's upper plasma layer is transferred to micro-centrifuge tubes and centrifuged. A predetermined amount of the clarified upper plasma layer of each sample is transferred to the first row of a standard 96-well U-bottom polypropylene microtiter plate. Prior to transfer, some wells in the microtiter plate are provided with pre-dispensed reagents as follows: 1) each well in Row A has a lysis/bind buffer with isopropanol and superparamagnetic DNA capturing paramagnetic particles (available from NeoGeneStar, Somerset, N.J.); 2) each well in Row B has a wash buffer with ethanol (available from NeoGeneStar); 3) each well in Row C has 80% ethanol; and 4) each well in Row D has an elution buffer (available from NeoGeneStar).

Following the addition of the 12 samples of xenograft mouse plasma to the wells in Row A, the plate is covered with sealing film and mixed on a microtiter plate mixer for a predetermined amount of time. After the incubation, the microtiter plate is briefly pulse-centrifuged to ensure all the liquids are in the bottom of the wells. The protracted position of a 3-position, 12 magnet device, as described above, is selected and a 12-strip PCR strip of sleeves 604 is placed on the device. The magnetic device with sleeve 604 is inserted into the wells of Row A to capture the magnetic particles. The magnetic particles on the sleeve are transferred to the wells of Row B. The retracted position is selected which releases the particles into the wash buffer. The protracted position is then selected and the particles are captured and transferred to the wells of Row C. The retracted position is selected and the particles are released into the ethanol. The protracted position is then selected and the particles are captured.

The magnetic device is removed from the microtiter plate and those particles that are on the sleeve are air dried. The magnetic device is then put in the wells of Row D and the retracted position is selected to release the magnetic particles into the elution buffer. After a predetermined period of time, the protracted position is selected and the magnetic particles are captured. Accordingly, the wells of row D now have the purified cfDNA from the 12 samples.

Example 2: Purification of cd45 Cells from a Mixed Population of Cells

Initially, an amount of MNC buffy coat cells from human blood is prepared as per standard methods and diluted in PBS with BSA in a centrifuge tube. An amount of pre-washed and re-suspended superparamagnetic beads covalently coupled to anti-human CD45 antibody, for example, Dynabeads® CD45 from ThermoFisher Scientific of Waltham, Mass., is added. The solution is incubated for a predetermined time and at a predetermined temperature while being tilted and rotated. The volume may be increased with isolation buffer to limit trapping of unbound cells.

A plastic sleeve 304 is placed over the distal end of the magnetic device, as described above, and the magnet/sleeve combination, with the magnet in the protracted position, is dipped into the solution in the tube. Gently moving the magnet/sleeve combination within the liquid for some amount of time will capture the superparamagnetic particles, with the bound cd45-expressing cells, to the surface of the sleeve 304. The device with the bound particles and cells is transferred to a centrifuge tube with isolation buffer. Moving the magnet to the retracted position releases the superparamagnetic particles with cells.

The cap to the centrifuge tube is then closed and the tube is inverted a number of times. The cap is then removed and the magnet set to the protracted position and inserted back in to capture the cd45-expressing cells bound to the superparamagnetic particles. The cells with particles can then be moved and inserted into appropriate culture media by moving the magnet from the sleeve back to the retracted position to release the cells into the culture media.

Each of the magnet devices 100, 400 described above may be provided in kit form where the device 100, 400 is provided along with instructions for processing solutions with magnetically susceptible particles. These instructions could be directed to, for example and not intended to be limiting, the purification of xenograft mouse cell free DNA and the purification of cd45 cells, as set forth above. The sleeves, vials, microtiter plates, solutions, etc., may also be included in the kit or they may be provided separately.

It is to be understood that the details of construction and the arrangement of the components set forth in the description or illustrated in the drawings are not limiting as there are other ways of being practiced or carried out. Also, it is to be understood that the phraseology and terminology employed herein are for the purpose of description only and also should not be regarded as limiting.

It is appreciated that certain features, which are, for clarity, described in the context of separate implementations, may also be provided in combination in a single implementation. Conversely, various features, which are, for brevity, described in the context of a single implementation, may also be provided separately or in any suitable sub-combination.

While various aspects have been described, it will be apparent to those of ordinary skill in the art that many more embodiments and implementations are possible and are within the scope of this disclosure.

The invention claimed is:

1. A device for capturing and releasing magnetically susceptible particles, comprising:

a housing having a proximal end and a distal end;

a retraction mechanism disposed within the housing; and a permanent axially magnetized cylindrical magnet disposed in the housing and coupled to the retraction mechanism, wherein a distal end of the magnet extends from the distal end of the housing, and wherein the retraction mechanism is configured to position the distal end of the magnet at one of a first, second or third predetermined distance from the distal end of the housing, defining a first, second and third position, respectively, and wherein the first predetermined distance is less than the second predetermined distance and the second predetermined distance is less than the third predetermined distance, and wherein the device further comprises a button, disposed in the proximal end of the housing, coupled to the retraction mechanism, wherein pressing the button to a maximum travel position causes the retraction mechanism to position the distal end of the magnet at the third predetermined distance from the distal end of the housing, and wherein the retraction mechanism comprises first and second ratchets, and wherein the first and second ratchets cooperate with one another to transition the distal end of the magnet between the first and second positions when the button is pressed to travel less than to the maximum travel position and released.

2. The device of claim 1, further comprising:

a ferromagnetic tube surrounding at least a portion of the magnet.

3. The device of claim 2, wherein the ferromagnetic tube comprises one of:

iron or stainless steel.

4. The device of claim 1, wherein the magnet comprises NdFeB.

5. The device of claim 1, further comprising:

a sleeve coupled to the distal end of the housing, wherein the sleeve is sized and arranged such that the magnet can move to the second position without disturbing the coupling of the sleeve to the housing.

6. The device of claim 5, wherein:

the sleeve is sized and arranged to decouple from the distal end of the housing when the distal end of the magnet is moved to a point between the second position and the third position.

7. A device for capturing and releasing magnetically susceptible particles, comprising:

a housing having a proximal end and a distal end;

a retraction mechanism, having a proximal end and a distal end, disposed within the housing;

a planar structure, disposed in the housing, coupled to the distal end of the retraction mechanism; and a plurality of permanent axially magnetized cylindrical magnets coupled to the planar structure, each magnet having a distal end extending from the distal end of the housing, wherein the retraction mechanism is configured to position the distal ends of the magnets at one of a first, second or third predetermined distance from the distal end of the housing, defining a first, second and third position, respectively, and wherein the first predetermined distance is less than the second predetermined distance and the second predetermined distances is less than the third predetermined distance, and wherein the device further comprises a button, disposed in the proximal end of the housing, coupled to the retraction mechanism, wherein pressing the button to a maximum travel position causes the retraction mechanism to position the distal ends of the magnets at the third position from the distal end of the housing, and wherein the retraction mechanism comprises first and second ratchets, and wherein the first and second ratchets cooperate with one another to transition the distal ends of the magnets between the first and second positions when the button is pressed to travel less than to the maximum travel position and then released.

8. The device of claim 7, further comprising:

a respective ferromagnetic tube surrounding at least a portion of a respective magnet.

9. The device of claim 8, wherein the ferromagnetic tube comprises one of:

iron or stainless steel.

10. The device of claim 7, wherein each magnet comprises NdFeB.

11. The device of claim 7, further comprising:

a plurality of sleeves coupled to the distal end of the housing, wherein each sleeve is sized and arranged such that a respective magnet can move to the second predetermined distance without disturbing the coupling of the sleeve to the housing.

12. The device of claim 11, wherein:

the plurality of sleeves is decoupled from the distal end of the housing when the distal ends of the magnets are moved to a point between the second position and the third position.

13. A kit for processing a solution including magnetically susceptible particles, the kit comprising:

a device for capturing and releasing magnetically susceptible particles; and printed instructions for operating the device to transfer magnetically susceptible particles, wherein the device comprises:

a housing having a proximal end and a distal end;

a retraction mechanism disposed within the housing; and a permanent axially magnetized cylindrical magnet disposed in the housing and coupled to the retraction mechanism, wherein a distal end of the magnet extends from the distal end of the housing, and wherein the retraction mechanism is configured to position the distal end of the magnet at one of a first, second or third predetermined distance from the distal end of the housing, defining a first, second and third position, respectively, and wherein the first predetermined distance is less than the second predetermined distance and the second predetermined distance is less than the third predetermined distance, and wherein the device further comprises a button, disposed in the proximal end of the housing, coupled to the retraction mechanism, wherein pressing the button to a maximum travel position causes the retraction mechanism to position the distal end of the magnet at the third position from the distal end of the housing, and wherein the retraction mechanism comprises first and second ratchets, and wherein the first and second ratchets cooperate with one another to transition the distal end of the magnet between the first and second positions when the button is pressed to travel less than to the maximum travel position and released, wherein the instructions comprise steps of:

operating the device to move the distal end of the magnet between the first and second positions in order to, respectively, release and capture the magnetically susceptible particles in the solution.

14. The kit of claim 13, further comprising:

a ferromagnetic tube surrounding at least a portion of the magnet.

15. The kit of claim 14, wherein the ferromagnetic tube comprises one of:

iron or stainless steel.

16. The kit of claim 13, wherein the magnet comprises NdFeB.

17. The kit of claim 13, further comprising:

a sleeve coupled to the distal end of the housing, wherein the sleeve is sized and arranged such that the magnet can move to the second position without disturbing the coupling of the sleeve to the housing.

18. The device of claim 17, wherein:

the sleeve is sized and arranged to decouple from the distal end of the housing when the distal end of the magnet is moved to a point between the second position and the third position.

19. A kit for processing a solution including magnetically susceptible particles, the kit comprising:

a device for capturing and releasing magnetically susceptible particles; and printed instructions for operating the device to transfer magnetically susceptible particles, wherein the device comprises:

a housing having a proximal end and a distal end;

a retraction mechanism, having a proximal end and a distal end, disposed within the housing;

a planar structure, disposed in the housing, coupled to the distal end of the retraction mechanism; and a plurality of permanent axially magnetized cylindrical magnets coupled to the planar structure, each magnet having a distal end extending from the distal end of the housing, wherein the retraction mechanism is configured to position the distal ends of the magnets at one of a first, second or third predetermined distance from the distal end of the housing, defining a first, second and third position, respectively, and wherein the first predetermined distance is less than the second predetermined distance and the second predetermined distances is less than the third predetermined distance, and wherein the device further comprises a button, disposed in the proximal end of the housing, coupled to the retraction mechanism, wherein pressing the button to a maximum travel position causes the retraction mechanism to position the distal ends of the magnets at the third position from the distal end of the housing, and wherein the retraction mechanism comprises first and second ratchets, and wherein the first and second ratchets cooperate with one another to transition the distal ends of the magnets between the first and second positions when the button is pressed to travel less than to the maximum travel position and then released, wherein the instructions comprise steps of:

operating the device to transition the distal ends of the magnets between the first and second positions in order to, respectively, release and capture the magnetically susceptible particles in the solution.

20. The kit of claim 19, further comprising:

a respective ferromagnetic tube surrounding at least a portion of a respective magnet.

21. The kit of claim 20, wherein the ferromagnetic tube comprises one of:

iron or stainless steel.

22. The kit of claim 19, wherein each magnet comprises NdFeB.

23. The kit of claim 19, further comprising:

a plurality of sleeves coupled to the distal end of the housing, wherein each sleeve is sized and arranged such that a respective magnet can move to the second position distance without disturbing the coupling of the sleeve to the housing.

24. The kit of claim 23, wherein:

the plurality of sleeves is decoupled from the distal end of the housing when the distal ends of the magnets are moved to a point between the second position and the third position.

* * * * *